US009828080B1

(12) United States Patent
Belter et al.

(10) Patent No.: US 9,828,080 B1
(45) Date of Patent: Nov. 28, 2017

(54) LOCKOUT FOR REMOTE CONTROLS ON MARINE VESSELS

(71) Applicant: Brunswick Corporation, Lake Forest, IL (US)

(72) Inventors: David J. Belter, Oshkosh, WI (US); Jeffrey J. Broman, Slinger, WI (US); Eric S. Mueller, Fond du Lac, WI (US)

(73) Assignee: Brunswick Corporation, Lake Forest, IL (US)

( * ) Notice: Subject to any disclaimer, the term of this patent is extended or adjusted under 35 U.S.C. 154(b) by 0 days.

(21) Appl. No.: 14/992,513

(22) Filed: Jan. 11, 2016

(51) Int. Cl.
*B63H 21/21* (2006.01)
*B63H 21/22* (2006.01)

(52) U.S. Cl.
CPC ..... *B63H 21/213* (2013.01); *B63H 21/22* (2013.01); *B63H 2021/216* (2013.01)

(58) Field of Classification Search
CPC . B63H 21/213; B63H 21/22; B63H 2021/216
See application file for complete search history.

(56) References Cited

U.S. PATENT DOCUMENTS 4,257,506 A 3/1981 Bankstahl
4,753,618 A 6/1988 Entringer
4,794,820 A * 1/1989 Floeter ..... B63H 21/213 477/34
4,952,181 A 8/1990 Entringer et al.
5,828,974 A * 10/1998 Hawarden ..... F16H 61/16 477/120
6,015,365 A 1/2000 Kolb et al.
6,692,320 B1 2/2004 Sawyer
6,755,703 B1 6/2004 Erickson
7,568,404 B2 * 8/2009 Grossman ..... F16H 59/0204 74/473.21
8,439,800 B1 5/2013 Bazan et al.
8,961,246 B1 2/2015 Kirchhoff et al.
9,043,058 B1 5/2015 Camp et al.
9,103,287 B1 8/2015 Arbuckle et al.
9,156,537 B1 * 10/2015 Nakayasu ..... B63H 25/02
9,272,764 B2 * 3/2016 Bamba ..... B63H 21/213
2004/0226801 A1 * 11/2004 De Jonge ..... F16H 59/0204 192/220.7

* cited by examiner

*Primary Examiner* — Todd Melton
(74) *Attorney, Agent, or Firm* — Andrus Intellectual Property Law, LLP

(57) ABSTRACT

An electromechanical lockout device for a remote control on a marine vessel includes an electric actuator and a locking pin having an engagement end and a second end. The locking pin is arranged with respect to a control lever such that the locking pin is positionable in a locked position, where the engagement end of the locking pin prevents rotation of the control lever into a reverse position, and in a retracted position, where the engagement end of the locking pin allows rotation of the control lever into the reverse position. A method of controlling lockout for a remote control includes sensing a position of a control lever, calculating a rate of change of the position, and engaging a lockout to prevent a gear system from shifting into reverse gear if the rate of change exceeds a threshold rate of change.

20 Claims, 9 Drawing Sheets

LOCKOUT FOR REMOTE CONTROLS ON MARINE VESSELS

FIELD

The present disclosure relates to lockouts for remote controls for marine vessels, and more specifically to electromechanical lockout devices and lockout control methods that prevent unwanted shifting into reverse gear.

BACKGROUND

The following U.S. patents and publications are hereby incorporated by reference herein.

U.S. Pat. No. 4,257,506 discloses a male cone member of a cone clutch mechanism that has two springs, each encircling cam faces on the male cone member and bearing against the forward and reverse clutch gears, respectively, to bias the cone member away from its center or neutral position toward either the forward or reverse clutch gear. An eccentric roller on the shift actuator shaft engages with a circumferential groove in the male cone member to provide a vibrating force against the member for shifting. The shift means uses a cam and bell crank mechanism to convert axial movement of the shift controller to rotary movement of the actuator shaft.

U.S. Pat. No. 4,753,618 discloses a shift cable assembly for a marine drive that includes a shift plate, a shift lever pivotally mounted on the plate, and a switch actuating arm pivotally mounted on the plate between a first neutral position and a second switch actuating position. A control cable and drive cable interconnect the shift lever and switching actuating arm with a remote control and clutch and gear assembly for the marine drive so that shifting of the remote control by a boat operator moves the cables to pivot the shift lever and switch actuating arm which in turn actuates a shift interrupter switch mounted on the plate to momentarily interrupt ignition of the drive unit to permit easier shifting into forward, neutral and reverse gears. A spring biases the arm into its neutral position and the arm includes an improved mounting for retaining the spring in its proper location on the arm.

U.S. Pat. No. 4,952,181 discloses a shift cable assembly for a marine drive having a clutch and gear assembly that includes a remote control for selectively positioning the clutch and gear assembly into forward, neutral and reverse, a control cable connecting the remote control to a shift lever pivotally mounted on a shift plate, a drive cable connecting the shift lever on the shift plate to the clutch and gear assembly, and a spring guide assembly with compression springs biased to a loaded condition by movement of the remote control from neutral to forward and also biased to a loaded condition by movement of the remote control from neutral to reverse. The bias minimizes chatter of the clutch and gear assembly upon shifting into gear, and aids shifting out of gear and minimizes slow shifting out of gear and returns the remote control to neutral, all with minimum backlash of the cables. The spring guide assembly includes an outer tube mounted to the shift plate, and a spring biased plunger axially reciprocal in the outer tube and mounted at its outer end to the shift lever.

U.S. Pat. No. 6,015,365 discloses a shift-assist circuit for reducing the clutch wear of a transmission on a marine propulsion system during the shift process by anticipating the probable shifting forces and providing an ignition-kill signal before the shift forces can build to an unacceptable level.

U.S. Pat. No. 6,692,320 discloses an actuation system for a gear selector of a marine propulsion device that incorporates an adjustable motion directing component that changes the path of travel of an actuator end of a push-pull cable. This adjustable change creates a beneficial effect by changing the relative positions of a shift shaft and associated link arms in relation to positions of a wire within a sheath of a push-pull cable.

U.S. Pat. No. 6,755,703 discloses a hydraulic assist mechanism for use in conjunction with a gear shift device that provides a hydraulic cylinder and piston combination connected by a linkage to a gear shift mechanism. Hydraulic pressure can be provided by a pump used in association with either a power trim system or a power steering system. Hydraulic valves are used to pressurize selected regions of the hydraulic cylinder in order to actuate a piston which is connected, by an actuator, to the gear shift mechanism.

U.S. Pat. No. 8,439,800 discloses a shift control system for a marine drive applies partial clutch engagement pressure upon initial shifting from forward to reverse to prevent stalling of the engine otherwise caused by applying full clutch engagement pressure upon shifting from forward to reverse.

U.S. Pat. No. 8,961,246 discloses systems and methods for controlling shift in a marine propulsion device. A shift sensor outputs a position signal representing a current position of a shift linkage. A control circuit is programmed to identify an impending shift change when the position signal reaches a first threshold and an actual shift change when the position signal reaches a second threshold. The control circuit is programmed to enact a shift interrupt control strategy that facilitates the actual shift change when the position signal reaches the first threshold, and to actively modify the first threshold as a change in operation of the marine propulsion device occurs.

U.S. Pat. No. 9,043,058 discloses methods and systems for facilitating shift changes in a marine propulsion device having an internal combustion engine and a shift linkage that operatively connects a shift control lever to a transmission for effecting shift changes amongst a reverse gear, a neutral position and a forward gear. A position sensor senses position of the shift linkage. A speed sensor senses speed of the engine. A control circuit compares the speed of the engine to a stored engine speed and modifies, based upon the position of the shift linkage when the speed of the engine reaches the stored engine speed, a neutral state threshold that determines when the control circuit ceases reducing the speed of the engine to facilitate a shift change.

U.S. Pat. No. 9,103,287 discloses drive-by-wire control systems and methods for a marine engine that utilize an input device that is manually positionable to provide operator inputs to an engine control unit (ECU) located with the marine engine. The ECU has a main processor that receives the inputs and controls speed of the marine engine based upon the inputs and a watchdog processor that receives the inputs and monitors operations of the main processor based upon the inputs. The operations of the main processor are communicated to the watchdog processor via a communication link. The main processor causes the watchdog processor to sample the inputs from the input device at the same time as the main processor via a sampling link that is separate and distinct from the communication link. The main processor periodically compares samples of the inputs that are simultaneously taken by the main processor and watchdog processor and limits the speed of the engine when the samples differ from each other by more than a predetermined amount.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

An electromechanical lockout device for a remote control on a marine vessel includes an electric actuator and a locking pin movable by the electric actuator and having an engagement end and a second end. The locking pin is arranged with respect to a control lever such that the locking pin is positionable in a locked position, where the engagement end of the locking pin prevents rotation of the control lever into a reverse position, and in a retracted position, where the engagement end of the locking pin allows rotation of the control lever into the reverse position.

In one embodiment, a shift control system for a marine drive includes a remote control having a base and a control lever movable by an operator to a reverse position that causes a gear system of a marine drive to shift into reverse gear, a neutral position that causes the gear system to shift into a neutral state, and a forward position that causes the gear system to shift into a forward gear. The shift control system further includes an electromechanical lockout device in the remote control that selectively prevents the control lever from rotating to the reverse position. The electromechanical lockout device has an electric actuator and a locking pin having an engagement end and a second end. The locking pin is movable by the electric actuator between a locked position where the engagement end of the locking pin prevents rotation of the control lever into a reverse position, and a retracted position that allows rotation of the control lever into the reverse position. The shift control system further includes a controller that selectively energizes the electric actuator to move the locking pin between the retracted position and the locked position.

One embodiment of a method of controlling lockout for a remote control having a control lever movable by an operator to shift a gear system of a marine drive into one of a forward gear, a reverse gear, and a neutral state, includes sensing a position of a control lever at a sample rate with a position sensor and calculating a rate of change of the position of the control lever. The method further includes determining whether the rate of change exceeds a threshold rate of change and engaging a lockout to prevent the gear system from shifting into reverse gear based on whether the rate of change exceeds the threshold rate of change.

Another embodiment of a shift control system for a marine drive includes a remote control having a base and a control lever movable by an operator to shift a gear system of a marine drive into one of a forward gear, a reverse gear, and a neutral state. The shift control system also has a controller and a lever position sensor that senses the position of the control lever at a sample rate. The controller calculates the rate of change of the position of the control lever based on the position sensed by the lever position sensor and determines whether the rate of change exceeds a threshold rate of change. The controller engages a lockout to prevent the shift control system from shifting into reverse gear based on whether the rate of change exceeds the threshold rate of change.

BRIEF DESCRIPTION OF THE DRAWINGS

The present disclosure is described with reference to the following Figures. The same numbers are used throughout the Figures to reference like features and like components.

DETAILED DESCRIPTION

Four stroke marine engines can ingest water through the exhaust and hydro-lock if they are accidentally shifted into reverse gear while the boat is moving forward at a sufficiently high speed. Namely, if the engine stalls, water forces acting on the propeller cause the propeller to turn backwards and cause the engine to take in water. For drive-by-wire systems having electronic shift control, electronic lockout algorithms may be used to prevent or delay shifting into reverse until the conditions allow the shift to occur without stalling, and thereby prevent hydro-lock. In systems with mechanical links between a shift control system and a gear system of a marine drive, such as a clutch, mechanical barriers have been used to prevent accidental shifts into reverse, such as spring loaded detents that require the operator to apply sufficient force or push a button in the remote control in order to overcome the detent and shift between neutral and reverse gear.

Through their experimentation and research in the field, the present inventors have recognized that spring loaded detents are inadequate for preventing accidental shifts into reverse gear. Moreover, mechanical devices requiring a operator to take action, such as applying extra force or pushing a button, to overcome the lockout may be undesirable, especially on a marine vessel having dual or quad engines where the operator needs to be able to easily move multiple shift levers at lower speeds, such as for docking maneuvers. Thus, the present inventors have recognized a need for and the desirability of a lockout system that may be selectively actuated in order to prevent the operator from accidentally shifting into reverse while the boat is moving forward at a high enough speed to cause hydro-lock. Furthermore, in marine vessels having a physical shift link connection between the shift control system and the gear system, a selectively operated mechanical lockout is desirable so that the remote control can shift easily from neutral to reverse except for in situations where hydro-lock is a concern.

Figure 1:
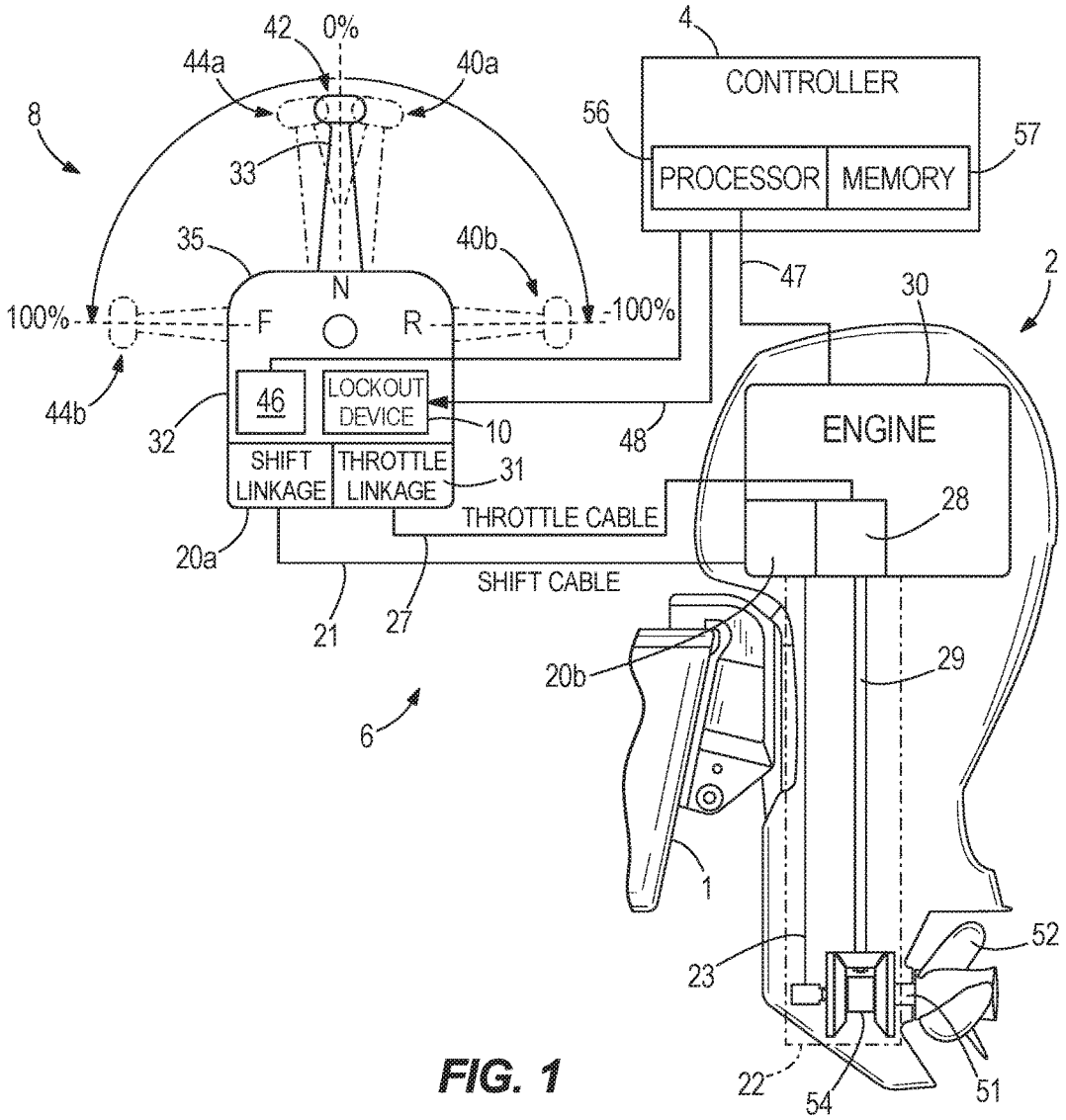
FIG. 1 depicts shift control system having a lockout and a marine drive according to one embodiment of the present disclosure.

FIG. 1 depicts an exemplary shift control system 6 for a marine drive 2 on a marine vessel 1. In the examples shown and described, the marine drive 2 is an outboard motor; however, the concepts of the present disclosure are not limited for use with outboard motors and can be implemented with other types of marine drives, such as inboard motors, inboard/outboard motors, hybrid electric marine propulsion systems, pod drives, and/or the like. In the examples shown and described, the marine drive 2 has an engine 30 causing rotation of a drive shaft 29 to thereby cause rotation of a propeller shaft 51. A propeller 52 connected to and rotating with the propeller shaft 51 propels the marine vessel 1 to which the marine drive 2 is connected. The direction of rotation of the propeller shaft 51 and propeller 52 is changeable by a gear system 22. In the example shown, the gear system 22 includes a clutch 54, and more specifically a conventional dog clutch. As is conventional, the clutch 54 is actuated between a forward gear, a neutral state, and a reverse gear by a shift rod 23. In the neutral state, the clutch is in a position between the forward and neutral gears but is not engaged with either gear, and thus no power is transmitted from the engine 30 to the propeller shaft 51. However, other types of clutches may equally be employed. In certain embodiments, the gear system 22 may include a transmission which may control the rotational connection between the drive shaft 29 and the propeller shaft 51.

The shift control system 6 also includes a remote control 8 having a base 32 and a control lever 33 extending therefrom. In the example of FIG. 1, the remote control 8 is a combination shift/throttle controller with control lever 33 pivotally movable between a range of reverse positions 40 between a reverse detent position (zero throttle) 40*a* and a reverse wide open throttle position 40*b*, a neutral position 42, and a range of forward positions 44 between a forward detent position (zero throttle) 44*a* and a forward wide open throttle position 44*b*, as is conventional. The remote control 8 is typically located at the helm of the marine vessel 1. For example, the remote control 8 may be a console mount remote control.

The control lever 33 is operably connected to a shift linkage 20 and a throttle linkage 31, such that pivoting the control lever 33 forward or back causes corresponding movement of the shift linkage 20 and/or throttle linkage 31. Portions 20*a* of the shift linkage 20 are located at the remote control 8, and other portions 20*b* of the shift linkage 20 are located at or near the engine 30 to connect to the shift rod 23. A shift cable 21 connects between the shift linkage portions 20*a* and 20*b* to translate movement therebetween, and ultimately to translate movement of the control lever 33 to the shift rod 23. A throttle cable 27 connects the throttle linkage 31 to the throttle valve 28, or to further linkage which connects to the throttle valve 28. Thus, the throttle cable 27 translates movement of the control lever 33 to a change in position of the throttle valve 28 of the marine engine 30. The throttle valve 28 increasingly opens as the control lever 33 moves from reverse position 40*a* toward 40*b*, and from forward position 44*a* toward 44*b*. Each of the shift cable 21 and the throttle cable 27 can be a galvanized steel cable, a linkage, or a similar connecting device or element.

The shift control system 6 also includes a controller 4 that is programmable and includes a processor 56, such as a microprocessor, and memory 57. The controller 4 can be located anywhere in the shift control system 6 and/or located remote from the shift control system 6, and can communicate with various components on the marine vessel 1 via wired and/or wireless links, as will be explained herein below. Although FIG. 1 shows a single controller 4, the shift control system 6 can include more than one controller 4, or control circuit. For example, the shift control system 6 may have a controller 4 located at or near the control lever 33 and can also have a controller 4 located at or near the marine drive 2. Each controller 4 can have one or more control functions and may cooperate, and one having ordinary skill in the relevant art will recognize that the controller 4 may have many different forms and is not limited to the example that is shown and described. For example, the controller 4 may comprise a microprocessor and other circuitry that retrieves and executes software from memory 57. A person having ordinary skill in the relevant art will understand in light of the present disclosure that the controller 4 can be implemented with a single processing device or may be distributed across multiple processing devices or sub-systems that cooperate to execute the control methods described herein. For example, the controller 4 may be a typical engine control module (ECM) or it may be a separate control circuit that is communicatively connected to one or more ECMs on the marine vessel. The memory 57 may comprise any storage media, or group of storage media, readable by the processor 56, which may be any processing device, or combination of processing devices. For example, the memory 57 may include volatile and/or non-volatile, removable and/or non-removable media implemented in any method or technology for storage of information, such as computer-readable instructions, data structures, program modules, or other data. Memory 57 may be implemented as a single storage device, or may be implemented across multiple storage devices or sub-systems. The processor 56 may be, for example, a general purpose central processing unit, an application specific processor, a logic device, or any other type of processing device or combination thereof.

In this example, the controller 4 communicates with one or more components of the marine drive 2 via control link 47, which may be a wired or wireless link. The controller 4 is capable of monitoring and controlling one or more operational characteristics of the marine drive 2, including of the engine 30 therein, by sending and receiving control signals via the control link 47. The controller 4 may also monitor one or more operational characteristics of the remote control 8. In an embodiment where the shift control system 6 is a drive-by-wire input device, the controller 4 may receive information regarding the position of the control lever 33, such as from a position sensor attached thereto, and translate the control input from the remote control 8 to the throttle valve 28 and/or shift rod 23, for example. Such drive-by-wire systems are known in the art, an example of which is disclosed at U.S. Pat. No. 9,103,287 which has been incorporated herein by reference. In a drive-by-wire system, the controller 4 may delay executing a shift command from the remote control 8 to shift into reverse gear until the engine speed has sufficiently decrease and conditions are such that the shift will not cause the engine 30 to stall, and/or until the boat speed is low enough that hydro-lock will not occur.

In an embodiment where the remote control 8 has a mechanical link to the shift and/or throttle systems in the marine drive 2, the controller 4 may provide monitoring and/or control functionality to assist the operator control. For example, the controller 4 may control a physical lockout device 10 associated with the remote control 8. For example, the lockout device 10 may be selectively operated by the controller 4 to prevent the operator from accidentally shifting into reverse gear when the marine vessel 1 is traveling at a high speed in the forward direction, thereby to prevent hydro-lock. Thus, the controller 4 may activate the lockout device 10 at high speeds in forward gear, but not at docking speeds. The lockout device 10 may also be associated with a disengage input, such as a button or other controller on the base 32 or lever 33 of the remote control 8 that can be depressed to disengage the lockout device 10. Accordingly, the lockout device 10 would prevent the operator from shifting into reverse while the marine vessel 1 is traveling at higher speeds in forward gear unless the operator clearly identifies intention to shift into reverse gear by hitting the disengage input. Preferably, such a disengage input would be at a location where it would not be accidentally depressed when the operator pulls back on the control lever 33 in a panic situation. Accordingly, it may be preferable to avoid putting the disengage input on a lower portion of a handle 34 of the control lever 33, which is a standard location for buttons used to disengage standard mechanical lockouts between neutral and reverse gears provided in many presently available remote control devices. These standard mechanical lockouts are often ineffective at preventing accidental shifts into reverse gear because the detent release button is often pressed by the operator in panicked actions pulling back on the control lever 33 to slow the marine vessel 1 as quickly as possible.

In one embodiment, the controller 4 may selectively operate the lockout device 10 based on input from a position sensor 46 that senses the position of the control lever 33, alone or in combination with other information regarding the speed of the marine vessel 1 and/or the engine 30.

Figure 2A:
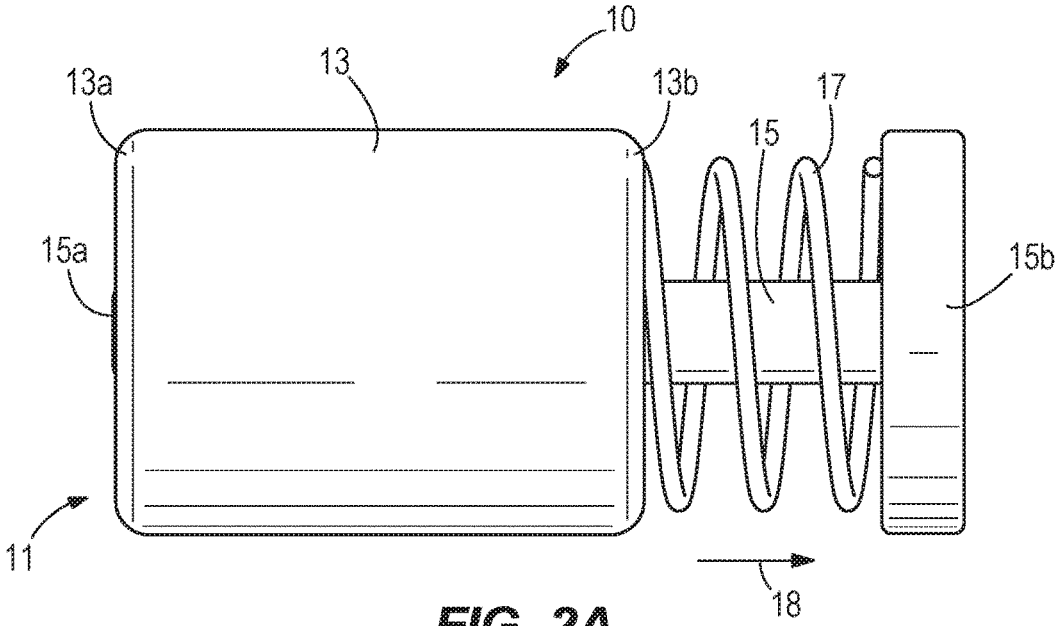
FIGS. 2A and 2B depict an electromechanical lockout device for a remote control on a marine vessel.
Figure 2B:
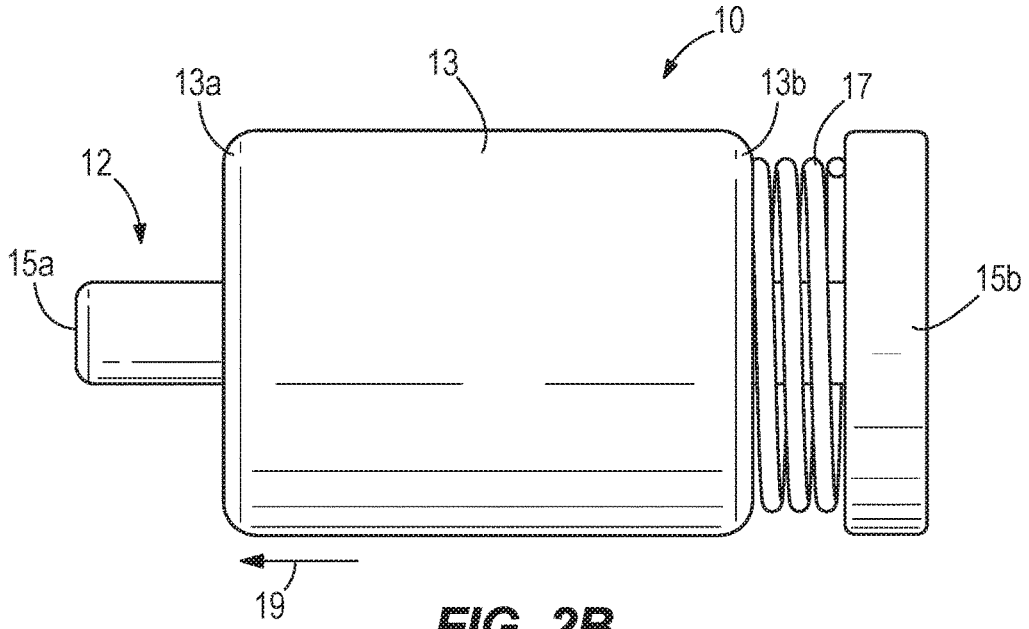

FIGS. 2A and 2B depict one embodiment of an electromechanical lockout device 10 which is selectively operable to prevent rotation of the control lever 33 into a reverse position 40. In the exemplary embodiment, the lockout device 10 includes an electric actuator in the form of a solenoid 13, having a first end 13*a* and a second end 13*b*, and a locking pin 15. The locking pin 15 extends through the center of the solenoid 13 such that an engagement end 15*a* of the locking pin 15 is proximate to the first end 13*a* of the solenoid, and a second end 15*b* of the locking pin is proximate to the second end 13*b* of the solenoid. In the depicted embodiment, a return spring 17 is positioned between the second end 13*b* of the solenoid and the second end 15*b* of the locking pin. The return spring 17 in the depicted embodiment is a compression coil spring that exerts a bias force in the direction of arrow 18 on the locking pin 15 in order to maintain the locking pin 15 in the retracted position 11 when the solenoid 13 is not energized.

FIG. 2A depicts the exemplary lockout device 10 in a retracted position 11, which in this embodiment is the non-activated position of the lockout device 10. Accordingly, if the solenoid 13 of the lockout device 10 were to fail, the locking pin 15 would be in its retracted position. When the solenoid is energized, it exerts a force on the locking pin 15 in the direction of arrow 19 in order to overcome the bias force in direction of arrow 18 exerted by the return spring 17 and to move the locking pin 15 into a locked position 12, as is depicted in FIG. 2B. In the locked position 12, the engagement end 15*a* of the locking pin 15 extends well past the first end 13*a* of the solenoid 13 in order to inhibit the movement of the control lever 33 into reverse position 40.

In other embodiments, the return spring 17 may be another type of spring device or positioned elsewhere in order to provide a force to bias the lockout device 10 into the retracted position 11. For example, the return spring 17 may be a tension-type coil spring device positioned between the first end 13*a* of the solenoid 13 and the engagement end 15*a* of the locking pin 15 to put a force on the locking pin 15 in the general direction of arrow 18 to pull the locking pin 15 into the retracted position 11. Such embodiment is depicted in the FIGS. 4A and 4B. In still other embodiments, the lockout device 10 may be configured such that the return spring 17 biases the locking pin 15 into the locked position 12 when the solenoid is not energized, and the locking pin is then moved into the retracted position 11 by energizing the solenoid 13 to overcome the bias force of the return spring 17.

In other embodiments, the electric actuator may be any other electrically activated device capable of moving the locking pin 15 between a retracted position that allows movement of the control lever 33 into the reverse position 40 and a locked position that inhibits, or prevents, movement of the control lever 33 into the reverse position 40. To provide other exemplary embodiments, the electric actuator may be a solenoid valve, a linear stepper motor, or a ball screw driven by a rotating DC motor (e.g., brushed or brushless).

Figure 3A:
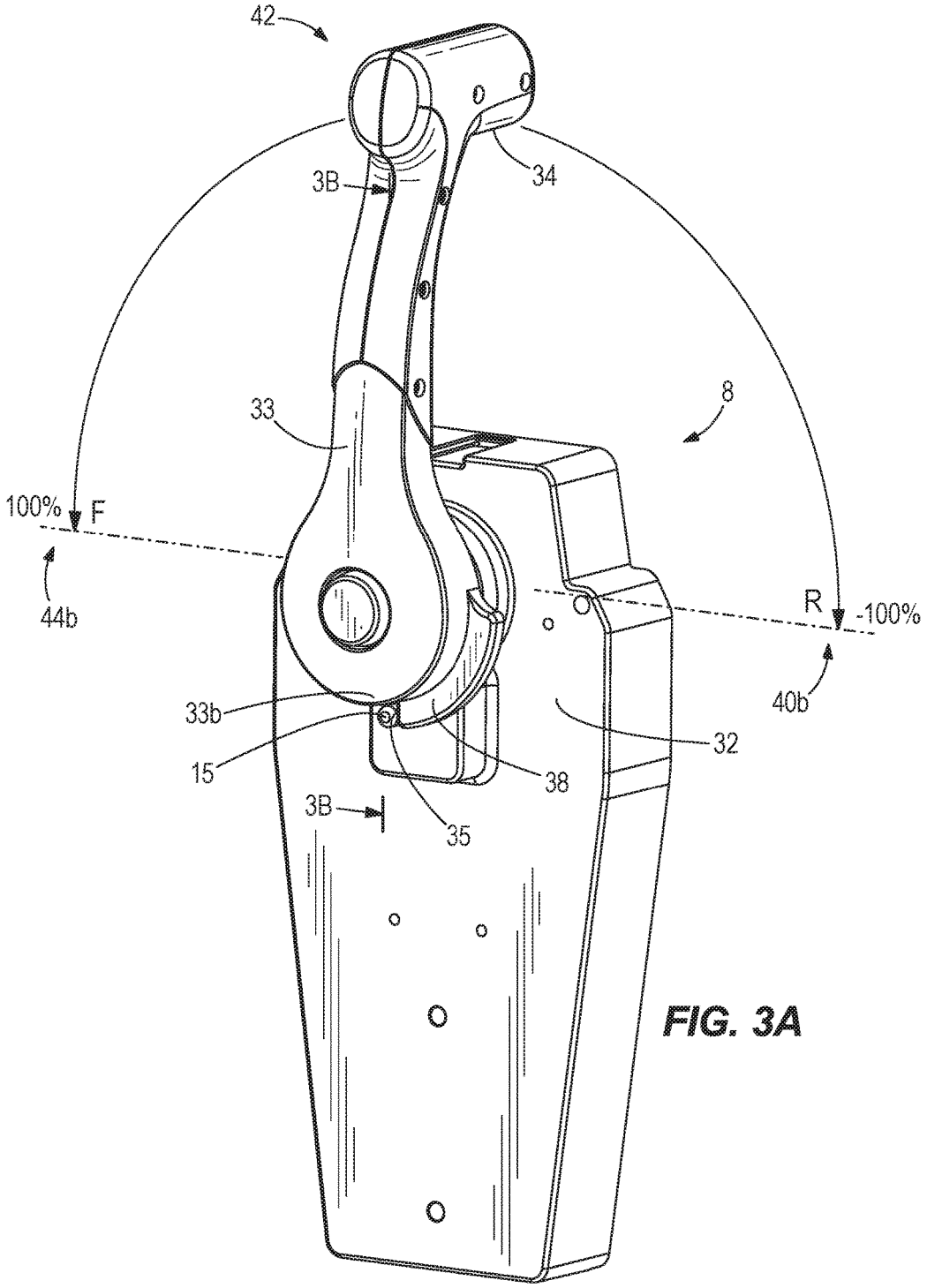
FIGS. 3A and 3B depict one embodiment of an electromechanical lockout device in a remote control of a marine vessel.
Figure 3B:
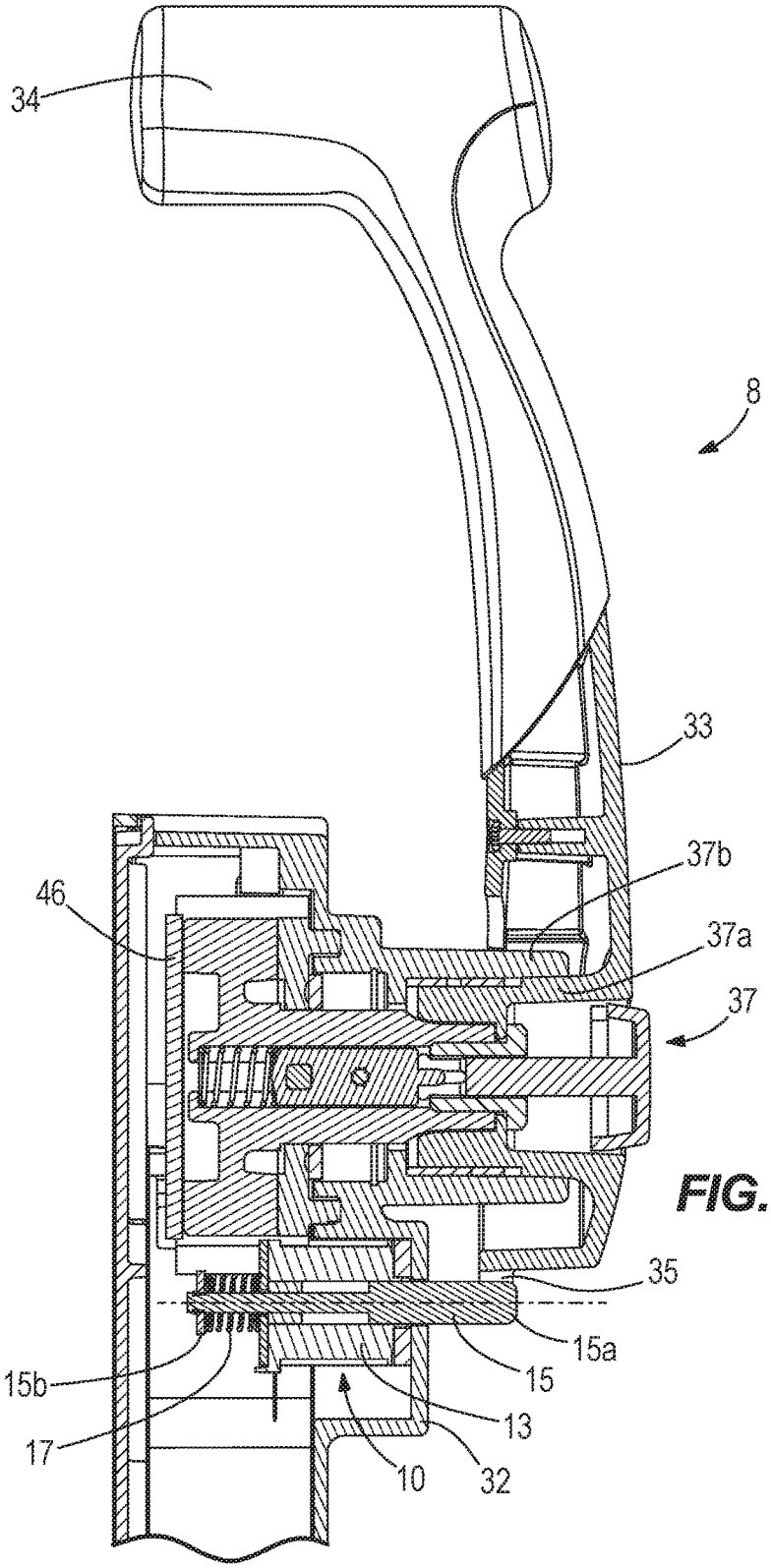

FIGS. 3A, 3B, 4A, and 4B depict various embodiments of a remote control 8 having such a lockout device. In FIGS. 3A and 3B, the lockout device 10 is positioned in the base 32 to engage a stop edge 35 on the control lever 33 to prevent the control lever 33 from moving into reverse position 40. In the exemplary embodiment, the stop edge 35 is on a protrusion 38 on a lower end 33*b* of the control lever 33. The protrusion 38 and stop edge 35 is positioned such that the stop edge 35 engages the locking pin 15 when the control lever 33 is in the neutral position 42 and the lockout device 10 is in the locked position 12. FIG. 3A depicts an exterior perspective view of the remote control 8 with the control lever 33 in a neutral position and the lockout device 10 in the locked position 12 engaging the stop edge 35 on protrusion 38 below the control lever 33. FIG. 3B depicts a cutaway view of the remote control 8 of FIG. 3A, dissecting the remote control 8 and the lockout device 10 therein. In the depicted embodiment, the control lever 33 connects to the base 32 at pivot joint 37 which has a lever portion 37*a* that rotatably connects to the base portion 37*b* of the pivot joint to provide a pivotable connection between the control lever 33 and the base 32. A position sensor 46 may be placed anywhere on the control lever 33 and/or the base 32 in order to sense the position of the control lever 33. In the depicted embodiment, the position sensor 46 is connected to the control lever 33 such that rotation of the control lever 33 causes equal rotation of the position sensor 46 such that the position, and the rate of change of position of the control lever 33 can be determined by the position sensor 46. The position sensor 46 may be any angular position sensor, and may provide an analog output or a digital output of position to the controller 4. For example, the position sensor 46 may be a programmable magnetic encoder, a clinometer, a Hall Effect sensor, a potentiometer, a rotary encoder, or the like. To provide one example, the position sensor 46 may be part number 881070 by Mercury Marine of Fond Du Lac, Wis.

Figure 4A:
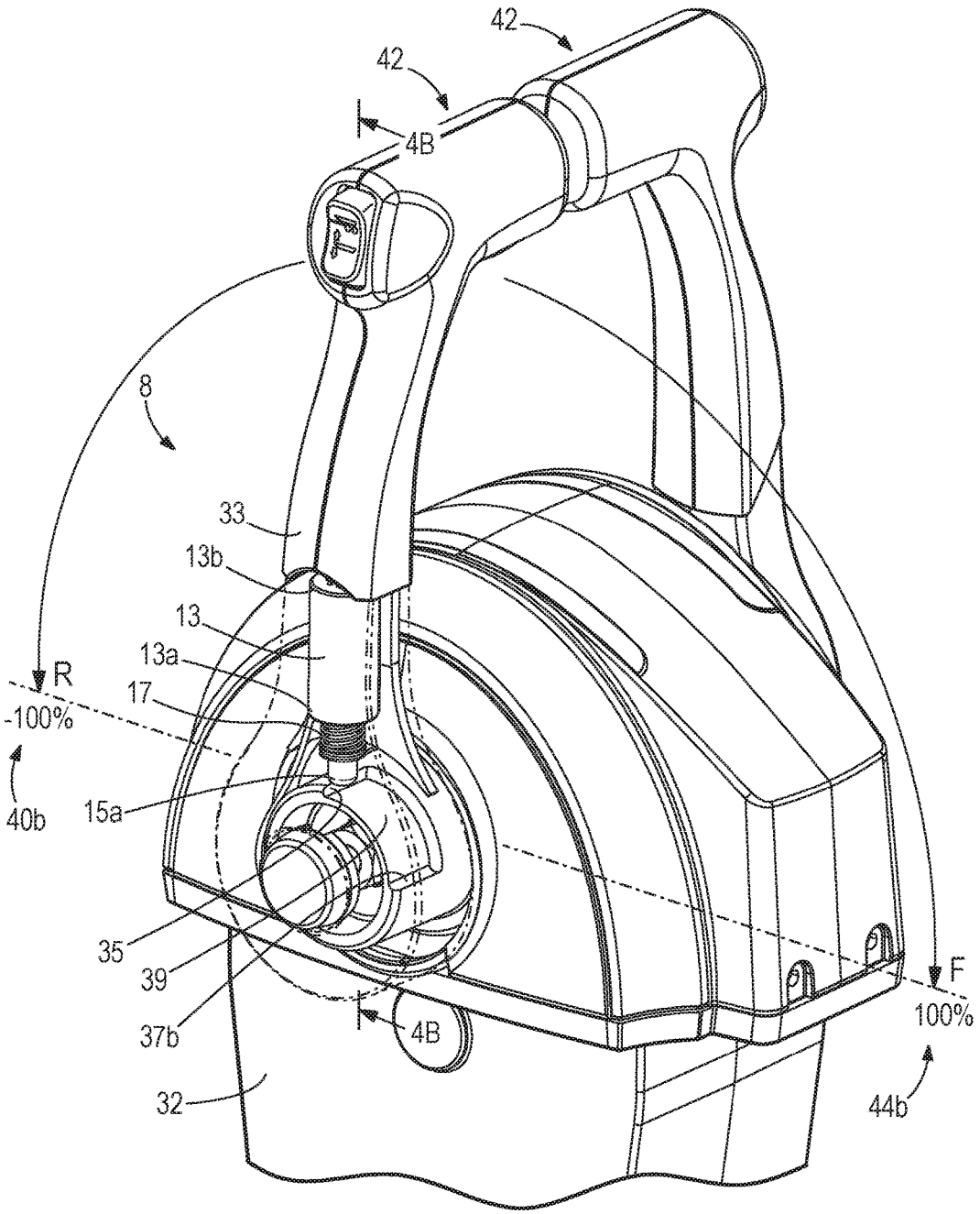
FIGS. 4A and 4B depict another embodiment of an electromechanical lockout device in a remote control of a marine vessel.
Figure 4B:
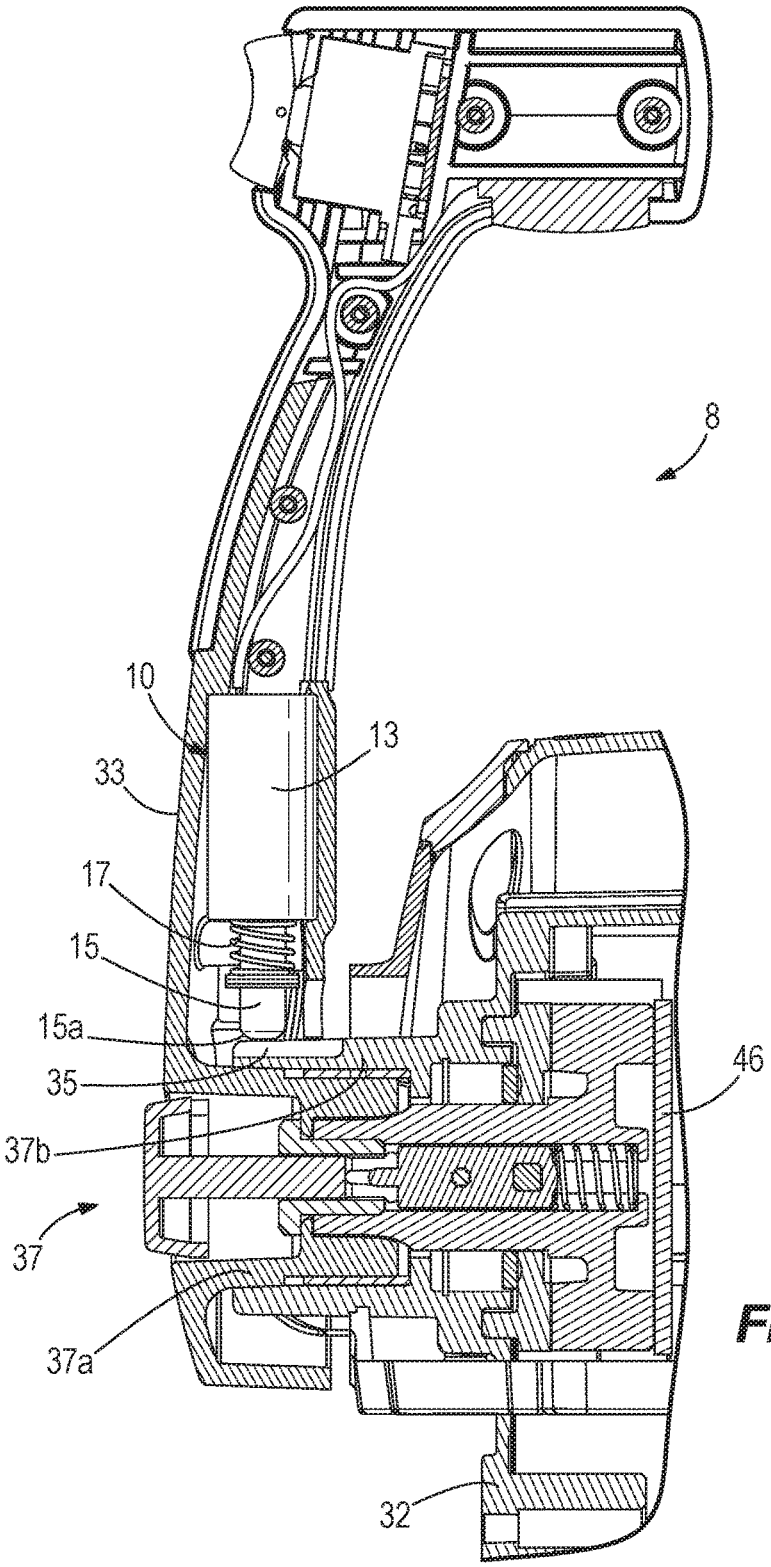

FIGS. 4A and 4B depict another embodiment where the lockout device 10 is in the control lever 33 and engages a stop edge 35 within the pivot joint 37 to prevent the control lever 33 from going to reverse position 40. In the depicted embodiment, the engagement end 15*a* of the locking pin 15 extends downward into an indentation 39 in the base portion 37*b* of the pivot joint 37. The indentation 39 extends partially around the base portion 37*b* of the pivot joint 37 such that the lockout device 10 does not prevent movement of the control lever 33 in the forward or neutral positions 44, 42. When the lockout device 10 is engaged, it only prevents the handle 33 from entering the reverse position 40 by the engagement end 15*a* contacting the stop edge 35 when the handle 33 is in the neutral position 42 to prevent any further motion of the handle 33 toward the reverse position 40.

FIGS. 5-8 depict various embodiments of a method of controlling lockout for a remote control 8 having a control lever 33 movable by an operator to shift a gear system 22 of a marine drive 2. Depending on the configuration of the gear system, such as whether it is a drive-by-wire system or a mechanical link system, the lockout may be activated by various means, which may be electronic control means or by an electromechanical lockout device such as that depicted in FIGS. 2-4 above. As described above, the purpose of the lockout is to prevent accidental shifting into reverse gear, and thereby stalling the engine 30, when the marine vessel 1 is traveling in the forward direction at a sufficiently high rate of speed such that the hydrodynamic forces on the propeller 52 could rotate the propeller and force water into the engine 30 through the exhaust system. The threshold speed at which such hydro-lock can happen varies depending on the configuration and size of the marine drive 2.

Accordingly, the lockout may be controlled based on the velocity of the marine vessel 1. As will be known to a person having ordinary skill in the relevant art, the velocity of the marine vessel 1 may be determined by a GPS system, by a speedometer, such as a speedometer having a paddle wheel, by a pitot tube, or by other means which are currently or may become known in the art. Alternatively, the lockout may be controlled based on any other sensed and/or calculated value that is roughly proportional to vessel speed, such as engine RPM, throttle position, or a calculation including engine RPM, throttle position, and/or time. Such lockout control may include engagement and disengagement of the lockout.

Figure 5:
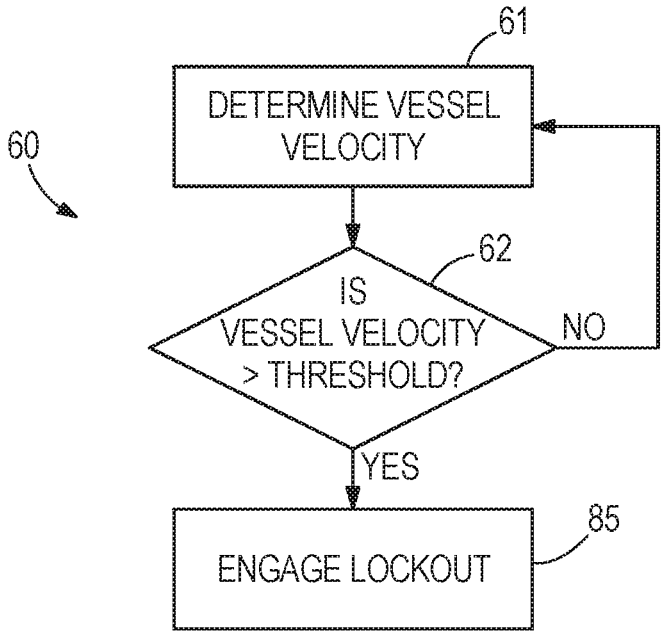
FIG. 5 depicts one embodiment of a method of controlling lockout for a remote control of a marine vessel.

In the flowchart of FIG. 5, a method 60 of controlling lockout engagement includes determining vessel velocity at step 61. For example, the controller 4 may receive the velocity from a speedometer or determine the velocity based on input from a GPS system. At step 62, the controller 4 determines whether the vessel velocity exceeds a threshold velocity. If the velocity does not exceed the threshold, then no action is taken and the controller 4 continues to monitor the velocity of the marine vessel 1. Once the velocity of the marine vessel 1 exceeds the threshold velocity, the lockout is engaged at step 85. For example, the lockout may be engaged at step 85 by energizing the solenoid 13 to place the lockout device 10 in the locked position 12. In alternative embodiments, engaging the lockout may alternatively involve the controller 4 not responding to a movement of the control lever 33 into the reverse position 40 by not sending an electronic control signal to the gear system 22 until conditions are safe and appropriate for a shift into reverse gear. Disengagement of the lockout can be controlled similarly, such that the controller 4 disengages the lockout once the vessel velocity falls below the threshold velocity.

Figure 6:
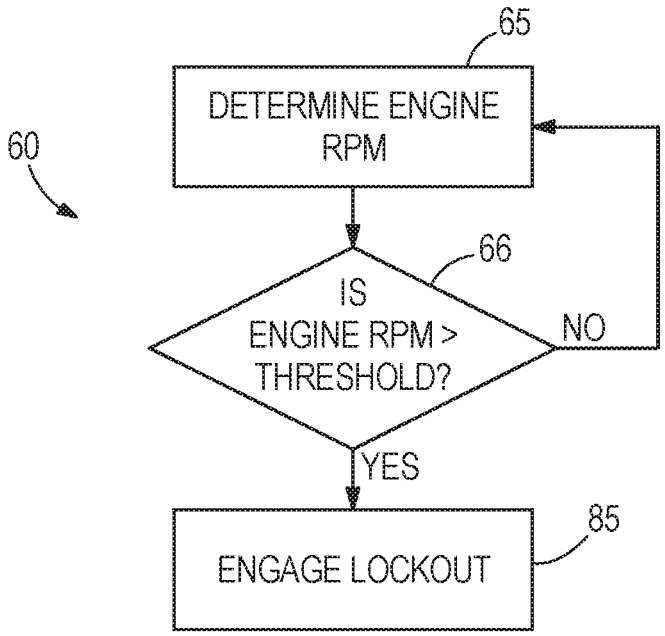
FIG. 6 depicts another embodiment of a method of controlling lockout of a remote control of a marine vessel.

FIG. 6 provides a flowchart depicting another embodiment of a method 60 of controlling lockout based on engine rpm, which in some embodiments may be used as a proxy for vessel velocity when the controller 4 does not have access to an actual vessel velocity measurement or to a GPS system providing measurements by which vessel velocity can be determined. In the depicted method 60, engine rpm is determined at step 65. At step 66, the controller 4 determines whether the engine rpm is greater than a threshold engine rpm. For example, the engine rpm threshold may be a preset engine speed which is likely to be associated with a vessel speed at which hydro-lock can occur. To provide an exemplary embodiment, the threshold engine rpm may be set at 1,000 rpm. If the engine rpm is not greater than the threshold, then the controller 4 returns to step 65 to monitor the engine rpm. Once the engine rpm becomes greater than the threshold, then the controller 4 may engage the lockout at step 85. Disengagement of the lockout can be controlled similarly, such that the controller 4 disengages the lockout once the engine rpm falls below the threshold.

Figure 7:
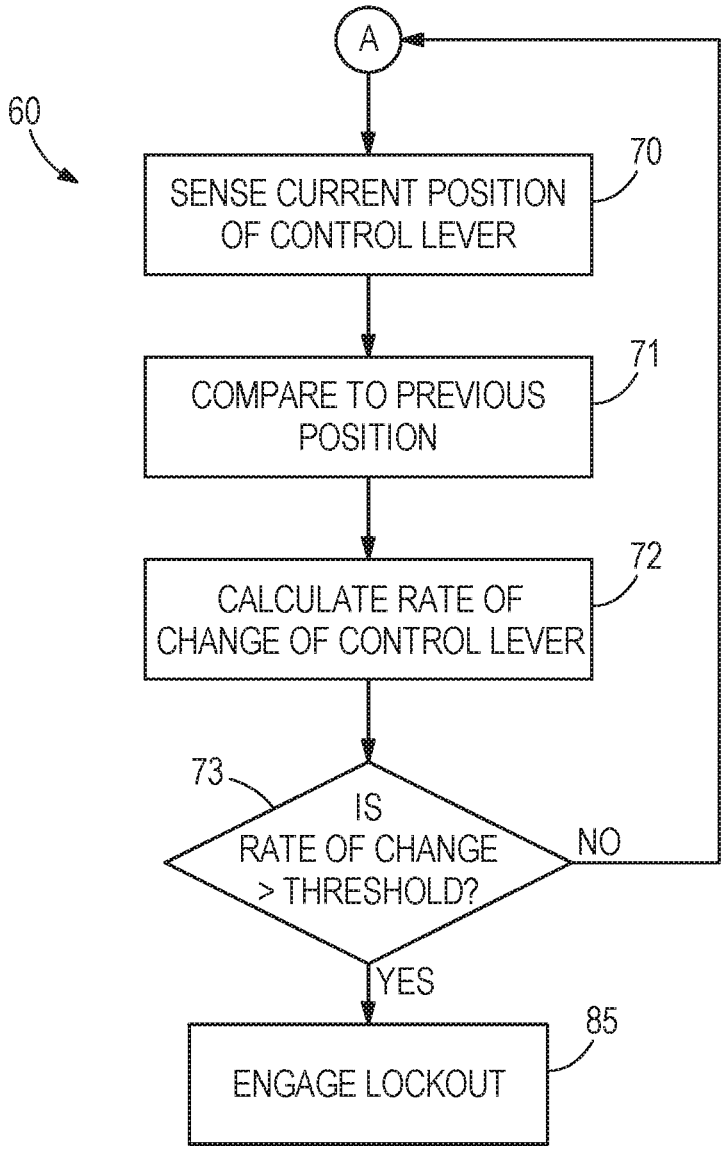
FIG. 7 depicts another embodiment of a method of controlling lockout for a remote control of a marine vessel.

FIG. 7 depicts another embodiment of a method 60 of controlling lockout. The method is initiated at point A. At step 70, the current position of the control lever 33 is sensed, such as by position sensor 46. At step 71, the current position of the control lever is compared to a previous position of the control lever, such as the last position sensed by the position sensor 46. For example, the position of the control lever 33 may be expressed as a percent of the range of motion of the control lever 33. For example, the neutral position 42 may be assigned 0%, the full throttle forward position 44*b* may be assigned 100%, and the full throttle reverse position 40*b* may be assigned −100%. The position of the control lever 33 sensed by the position sensor 46 may then be expressed on that scale between −100% and +100%, with 0% being the neutral position 42. The position of the control lever 33 may be read by the position sensor 46 at a fixed sampling rate (f), which in an exemplary embodiment might be in the range of 5 Hz-10 Hz. For example, samples may be assigned an index value (n) by which comparisons can be made between the most recent sample and those preceding it.

At step 72, a rate of change of the control lever is calculated. For example, the rate of change of the control lever 33 may be calculated according to the following equation:

$$\dot{x} = \frac{dx}{dt} = \frac{x_n - x_{n-1}}{1/f}$$

At step 73, the controller 4 determines whether the rate of change is greater than a threshold rate of change. This assumes that the rate of change value when the lever moves from the maximum forward position 44*b*, for example, towards the reverse position 40*a*, for example, would be assigned a positive value. Thus, the absolute value of the rate of change value ($\dot{x}$) may be used. Alternatively, the rate of change value ($\dot{x}$) may be expressed as a negative number to indicate a direction toward the reverse position, and threshold rate of change would also be a negative number. In such an embodiment, the threshold would be "exceeded" if the rate of change ($\dot{x}$) is less than the threshold rate of change. If the threshold is not exceeded, the method reinitiates at point A. If the rate of change does exceed the threshold, then the lockout may be engaged at step 85. In other embodiments, further analysis may be provided when it is determined at step 73 that the rate of change exceeds the threshold. For example, the controller 4 may then assess the vessel velocity and/or the engine rpm to determine if those values are greater than a threshold before determining whether or not to engage the lockout at step 85. Accordingly, after step 73, the controller may proceed with the steps outlined in FIG. 5 and/or FIG. 6.

Figure 8:
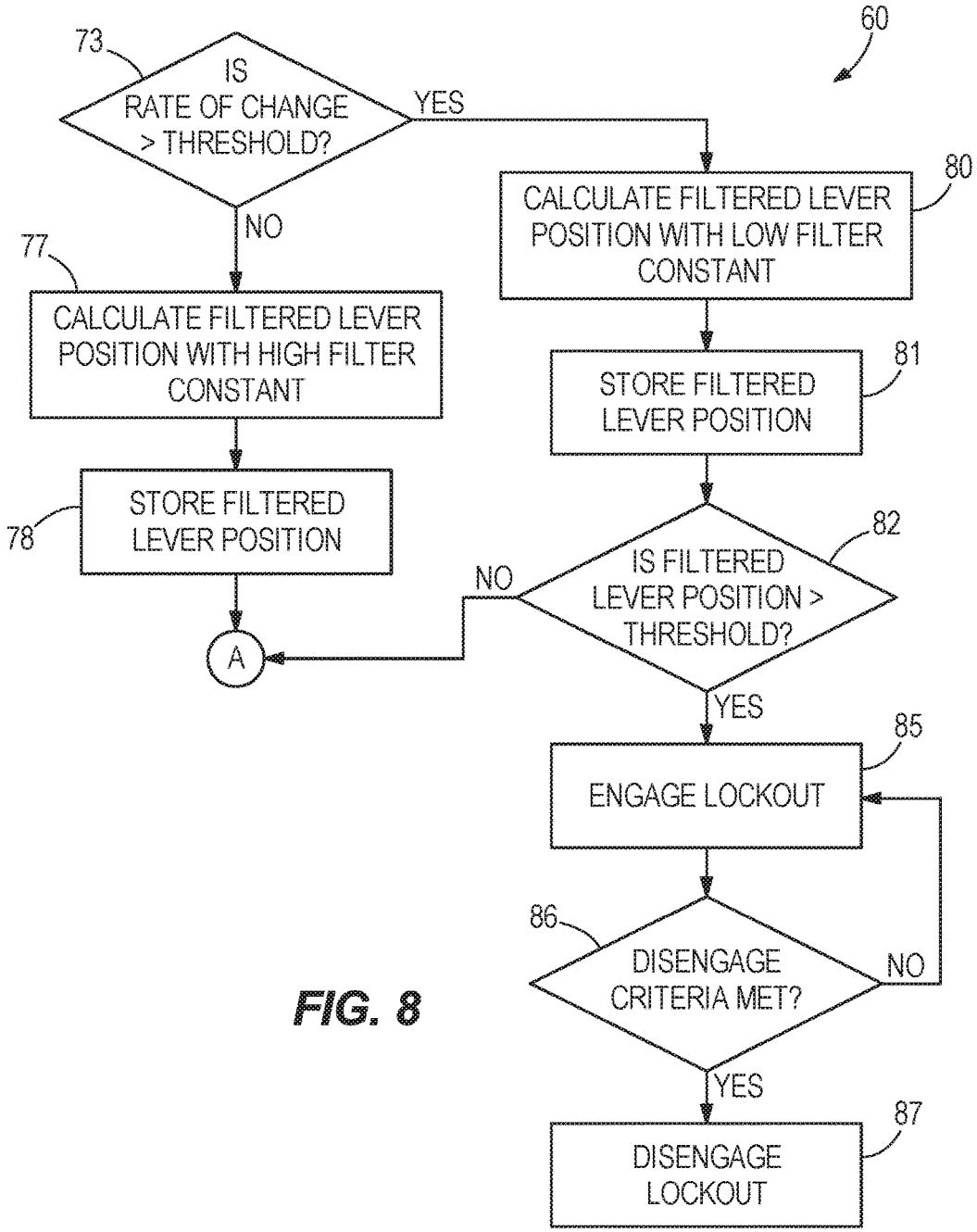
FIG. 8 depicts another embodiment of a method of controlling lockout for a remote control of a marine vessel.

In another embodiment, if the rate of change exceeds the threshold at step 73, the method steps outlined in FIG. 8 may be executed, which includes calculating a filtered lever position that accounts for both the current lever position and a previously-calculated filtered lever position. The filtered lever position may further account for the value of the rate of change calculated at step 72 such that a filter constant (C) may be adjusted based on the rate of change value (i). The filtered lever position (y) may be calculated according to the following equation:

$$y_n = C \cdot x_n + (1 - C) \cdot y_{n-1}$$

If at step 73 the rate of change is not greater than the threshold, then the controller 4 may proceed to step 77 where it calculates a filtered lever position (y) using a high filter constant. If at step 73 the rate of change is greater than the threshold, then the controller 4 may proceed to step 80 where it calculates the filtered lever position (y) with a low filter constant. To provide one exemplary embodiment, the threshold rate of change may be, for example, 30% per second. In another embodiment, the threshold value may be 50% per second, such as where high boat speed and/or hydro-lock are less of a concern. In an embodiment where motion toward the reverse position 40 is assigned a negative directional value, the threshold value may be −50%.

Accordingly, the filtered lever position (y) is highly responsive to the current lever position value sensed at step 70 when the rate of change of the control lever 33 is less than the threshold, and the filtered lever position value (y) becomes much less responsive when the rate of change is greater than the threshold value. Alternatively, as described above, if movement towards the reverse position is assigned a negative number and the threshold is a negative value, then the assessment at step 73 may be whether the rate of change is less than the threshold value. The filtered lever position (y) will have a fast update rate when the control lever 33 is moved slowly in either direction, or if the control lever 33 is moved quickly toward the full throttle forward position 44*b*. However, when the lever is in a forward position 44 and is moved quickly toward a reverse position 40, the update rate of the filtered lever position is slowed down so that the system is able to "remember" where it started prior to the rapid movement of the control lever 33. By way of example, the high filter constant used when the threshold is not exceeded may be 0.95, and the low filter constant used when the threshold is exceeded may be 0.05. The filter constants may be stored in a lookup table, for example.

Returning to step 77, where the rate of change does not exceed the threshold, the filtered lever position (y) is calculated with a high filter constant at step 77, and the value is stored at step 78. The controller 4 then returns to point A (FIG. 7) to initiate a new sensing cycle. In the instance where the rate of change exceeds the threshold at step 73, the controller 4 calculates a filtered lever position (y) with the low filter constant at step 80. At step 81, the filtered lever position that was calculated at step 80 is stored. It is then determined at step 82 whether the filtered lever position is greater than a threshold filtered lever position. If the filtered lever position (y) is not greater than a threshold, then the system returns to point A to engage in a new sensing cycle. Accordingly, if the control lever 33 was not beyond a certain accelerated position as represented by the threshold value, then the lockout will not be engaged. If, on the other hand, it is determined at step 82 that the filtered lever position (y) is greater than the threshold filtered lever position, then the lockout may be engaged at step 85. By way of example, the threshold filtered lever position may be 50% of the maximum travel of the control lever in the forward direction, or half way between the initial forward position 40*a* and the full throttle forward position 44*b*. Accordingly, four possible states for the rate of change ($\dot{x}$) of the control lever 33 and the filtered lever position (y) exist, and only one of these enables engagement of the lockout.

Once the lockout has been engaged at step 85, a process for disengaging the lockout will be initiated. As depicted in FIG. 8, at step 86 it is determined whether the criteria have been met in order to disengage the lockout. If the criteria are not met, then lockout is maintained at step 85 until such time as the criteria are met, at which point the lockout is disengaged at step 87. The disengagement criteria could be time based, based on the velocity of the marine vessel, based on engine rpm, or based on operator input. In one embodiment, the lockout may always be engaged for a preset period of time. In another embodiment, the lockout engagement duration may be based on the value of the filtered lever position calculated at step 82, where a longer lockout time is assigned for a higher filtered lever position. Such lockout times could be stored in a lookup table accessed by the controller 4. In another embodiment, the lockout may be released once the velocity of the marine vessel 1 falls below a threshold velocity, or once the engine rpm falls below a threshold rpm. For example, such thresholds may be those described above with respect to FIGS. 5 and 6. In still another embodiment, the lockout may not be released until an operator actively unlocks it, such as by a dedicated override button provided on or near the remote control 8. In one embodiment, a warning light is activated, such as on the remote control 8, when the lockout is engaged in order to inform the operator of the lockout. In such an embodiment, the warning may also instruct the operator that they need to manually disengage the lockout before they are able to shift into reverse gear. In still another embodiment, the lockout may be disengaged once the operator shifts from neutral into forward gear.

For marine vessels having multiple marine drives 2 and multiple remote controls 8 associated therewith, the lockout may be controlled separately for each marine drive. For example, in embodiments where multiple marine drives 2 are present on a marine vessel, each marine drive 2 may have a separate remote control 8 with a separate lockout device 10, where each lockout device 10 is controlled according to one or more of the various methods 60 provided herein. In other embodiments, all of the marine drives 2 on a particular vessel may be locked out together. In such an embodiment, if the conditions for one of the remote controls 8 and/or marine drive 2 met the conditions for lockout, the lockout would be engaged for all marine drives on the marine vessel 1 such that none could shift into reverse gear until the disengage criteria is met.

In the above description, certain terms have been used for brevity, clarity, and understanding. No unnecessary limitations are to be inferred therefrom beyond the requirement of the prior art because such terms are used for descriptive purposes and are intended to be broadly construed. The different systems described herein may be used alone or in combination with other systems. It is to be expected that various equivalents, alternatives and modifications are possible within the scope of the appended claims.

What is claimed is:

1. An electromechanical lockout device for a remote control on a marine vessel, the remote control having a control lever movable by an operator to a reverse position that causes a gear system of a marine drive to shift into a reverse gear, a neutral position that causes the gear system to shift into a neutral state, and a forward position that causes the gear system to shift into a forward gear, the lockout device comprising:

an electric actuator; and a locking pin movable by the electric actuator, the locking pin having an engagement end and a second end;

wherein the locking pin is arranged with respect to a control lever such that the locking pin is movable by the electric actuator to a locked position where the engagement end of the locking pin prevents the control lever from moving into the reverse position, and to a retracted position that allows the control lever to move into the reverse position.

2. The electromechanical lockout device of claim 1, further comprising a return spring that biases the locking pin to the retracted position when the electric actuator is not energized, wherein the locking pin is moved into the locked position by energizing the electric actuator to overcome a bias force of the return spring.

3. The electromechanical lockout device of claim 2, wherein the electric actuator is a solenoid and the return spring is a compression spring positioned between a second end of the solenoid and the second end of the locking pin.

4. The electromechanical lockout device of claim 2, wherein the electric actuator is a solenoid and the return spring is a tension spring positioned between a first end of the solenoid and the engagement end of the locking pin.

5. The electromechanical lockout device of claim 1, wherein the locking pin is housed in the control lever such that, when the locking pin is in the locked position, the engagement end engages a stop edge in a base of the remote control to prevent the control lever from moving to the reverse position.

6. The electromechanical lockout device of claim 5, wherein the stop edge is in a pivot joint between the base and the control lever and located such that the engagement end of the locking pin engages the stop edge when the control lever is in a neutral position and the locking pin is in the locked position.

7. The electromechanical lockout device of claim 1, wherein the locking pin is housed in a base of the remote control and, when the locking pin is in the locked position, engages a stop edge on the control lever to prevent movement of the control lever into the reverse position.

8. A shift control system for a marine drive comprising:

a remote control having a base and a control lever rotatable by a operator to a reverse position that causes a gear system of a marine drive to shift into a reverse gear, a neutral position that causes the gear system to shift into a neutral state, and a forward position that causes the gear system to shift into a forward gear;

an electromechanical lockout device in the remote control that selectively prevents the control lever from moving to the reverse position, the electromechanical lockout device having an electric actuator, and a locking pin movable by the electric actuator, the locking pin having an engagement end and a second end, wherein the locking pin is movable between a locked position where the engagement end of the locking pin prevents rotation of the control lever into a reverse position, and a retracted position where the locking pin is retracted such that no contact is made with the engagement end so as to allow rotation of the control lever into the reverse position; and a controller that selectively energizes the electric actuator to move the locking pin between the retracted position and the locked position.

9. The shift control system of claim 8, wherein the electric actuator is a solenoid, and further comprising a return spring that biases the locking pin into the retracted position when the solenoid is not energized, and the controller energizes the solenoid to overcome a bias force of the return spring to move the locking pin to the locked position.

10. The shift control system of claim 9, wherein the electric actuator is a solenoid and the controller energizes the solenoid to move the locking pin to the locked position based on a rate of change of a position of the control lever.

11. The shift control system of claim 10, further comprising a position sensor that senses the position of the control lever at a sample rate, and wherein the controller calculates the rate of change of the position of the control lever based on the position sensed by the lever position sensor.

12. The shift control system of claim 11, wherein the controller calculates a filtered lever position and energizes the solenoid to move the locking pin to the locked position further based on the filtered lever position.

13. The shift control system of claim 12, wherein the controller energizes the solenoid to move the locking pin to the locked position when the rate of change of the position of the control lever is less than a threshold rate of change and the filtered lever position is greater than a threshold filtered lever position.

14. The shift control system of claim 13, wherein a rate of change toward the reverse position is assigned a negative directional value and the rate of change exceeds the threshold rate of change when it is a negative number with a greater absolute value than the absolute value of the threshold rate of change.

15. The shift control system of claim 14, wherein the threshold rate of change is −50% per second and the threshold filtered lever position is 50% of a maximum travel of the control lever in the forward direction.

16. The shift control system of claim 9, wherein the electric actuator is a solenoid and the controller energizes the solenoid to move the locking pin to the locked position based on a vessel speed.

17. The shift control system of claim 9, wherein the electric actuator is a solenoid and the controller energizes the solenoid to move the locking pin to the locked position based on an engine RPM of the marine drive.

18. The shift control system of claim 8, wherein the locking pin is housed in the control lever and, when the locking pin is in the locked position, the engagement end engages a locking edge in the base to prevent rotation of the control lever.

19. The shift control system of claim 8, wherein the locking pin is housed in the base and, when the locking pin is in the locked position, engages a locking edge on the control lever to prevent its rotation.

20. A shift control system for a marine drive, the shift control system comprising:

a remote control having a base and a control lever movable by an operator to shift a gear system of a marine drive into one of a forward gear, a reverse gear, and a neutral state;

a lever position sensor that senses the position of the control lever at a sample rate;

an electromechanical lockout device;

a controller that:

calculates the rate of change of the position of the control lever based on the position sensed by the lever position sensor;

determines whether the rate of change exceeds a threshold rate of change; and engages the electromechanical lockout device based on whether the rate of change exceeds the threshold rate of change to prevent rotation of the control lever into a reverse position and the shift control system from shifting into reverse gear.

* * * * *